United States Patent [19]

Huang

[11] Patent Number: 4,847,923

[45] Date of Patent: Jul. 18, 1989

[54] WATER AND AIR WHIRLPOOLING DOUBLE FLUSH TOILET CLOG REMOVER

[76] Inventor: Chin-Hwa Huang, 21, Nan-Ti Rd., Hsi Hu Chen, Chunghwa Hsien, Taiwan

[21] Appl. No.: 130,692

[22] Filed: Dec. 8, 1987

[51] Int. Cl.[4] ..... E03D 11/00

[52] U.S. Cl. ..... 4/256

[58] Field of Search ..... 4/255–257

[56] References Cited

U.S. PATENT DOCUMENTS

| | | | |
|---|---|---|---|
| 886,353 | 5/1908 | Darling | 4/255 |
| 950,549 | 3/1910 | Kurrus | 4/255 |
| 1,154,055 | 9/1915 | Reeves | 4/255 |
| 1,574,274 | 2/1926 | Allender | 4/255 X |
| 1,734,206 | 11/1929 | Fisch | 4/256 |
| 1,769,061 | 7/1930 | Hitchcock | 4/255 X |
| 1,861,899 | 6/1932 | Beach | 4/256 |
| 2,187,043 | 1/1940 | MacMillan | 4/256 X |
| 2,670,475 | 3/1954 | Hord | 4/256 |
| 2,697,842 | 12/1954 | Meyer | 4/255 |
| 4,186,451 | 2/1980 | Ruo | 4/256 X |

FOREIGN PATENT DOCUMENTS

| | | | |
|---|---|---|---|
| 17800 | of 1910 | United Kingdom | 4/256 |

*Primary Examiner*—Charles E. Phillips

*Attorney, Agent, or Firm*—Varndell Legal Group

[57] ABSTRACT

The present invention relates to a water and air whirlpool double flush toilet clog remover having a hollow cylinder, a top cover with air ports attached to the cylinder, a fixed direction filling device having a piston within the cylinder and a hollow plug pressure lever with one end attached to the piston and another end passing through the top cover and attached to a handle, and a guide flow device attached to the bottom of the cylinder. The fixed direction filling device provides one-way directional flow of water and/or air into the cylinder from the hollow plug pressure lever, when the handle is raised. The guide glow device provides a whirlpool of water and/or air into the toilet to be unclogged when the handle is lowered.

5 Claims, 3 Drawing Sheets

WATER AND AIR WHIRLPOOLING DOUBLE FLUSH TOILET CLOG REMOVER

BACKGROUND AND SUMMARY OF THE INVENTION

Conventional flush toilets are very easily clogged at the position in a building where their ducts bend. Therefore, it is necessary to use the compressed flush of a clog remover to clear clogs therein. The conventional removers use an air pressure pushing power. FIG. 1 shows an air cylinder having an iron tubular shaft rod and an air port provide therein. In the space inside the air cylinder, a rubber piston pad is pivoted at the end of the tubular shaft rod. A cup with a suction disc is sleeved on the bottom end of the cylinder. The suction disc is placed on the opening of the flush toilet. The up and down displacements of the iron tubular shaft rod causes the rubber piston pad to compress the air in the cylinder to effect overall direct impact on the flush toilet or the dirty water surface in the drainage pipe, thereby achieving the effect of removing the clogs therein. However, in use, this structure relies on air surface impact. Since foul water or fluid is often in the flush toilet, it is inconvenient to apply direct gaseous pressure thereto. However, if indirect fluid impact is attempted, the pressure can dissipate, and air bubbles can escape. Further, since no check valve is provided on its bottom, the pressing and pulling actions, especially during the pulling back process, can cause foul water to be sucked into the air cylinder. The residual bad odor is hard to remove. Also, because the piston pad does not tightly fit with the air cylinder, the foul water can be carelessly sucked into the air cylinder during its operation and infiltrate to the upper side of the piston pad. The subsequent pulling back action can cause the foul water to sputter out of the air port and disgust the user. Furthermore, the bottom directly contacts and compresses the dirty water causing the dirty water to eject and sputter out around the suction disc and to pollute the surrounding environment or the user's body. All of the above are the defects of a device such as that shown in FIG. 1. Additionally, the structure has some iron members which can easily rust or corrode, and the manufacture of the device is often a labor-and-time-consuming process.

The main object of the present invention is to provide the structure of a water and air whirlpooling double flush toilet clog remover by using an unidirection-pouring or filling device. A plurality of air nozzles, which have different inner diameters and are arranged at different angles, are provided on an extended duct. These nozzles can extend deep into the drainage pipe. A corrugated suction disc is used which is elastic, compressible and extensible, thereby increasing its sealing power and making it adaptable to water drainage devices of various types. Downward movement of the piston of the clog remover of the present invention pushes the water and/or air within the cylinder, causing it to flow through the air nozzles at approximately 70 kg of impact pressure. This rushing of water and/or air contacts the wall face of the toilet and results in a whirlpool of water and/or air, thereby achieving the effect of removing the clogs and cleaning the toilet.

Another object of the present invention is to provide a structure for a water and air whirlpooling double flush toilet clog remover in which the fixed direction filling device can directly provide water as a medium to generate a whirlpooling water flow together with the dirty water in the toilet. This elevates its impact pressure and reduces the dissipation of its impact pressure.

A further object of the present invention is to provide the structure a water and air whirlpooling double flush toilet clog remover in which the suction disc of the flow guide disc device has a hollow corrugated retractable pleated body, so that the clog remover of the present invention can accommodate water drainage devices of various types.

DETAILED DESCRIPTION OF THE PREFERRED EMBODIMENT

Figure 1:
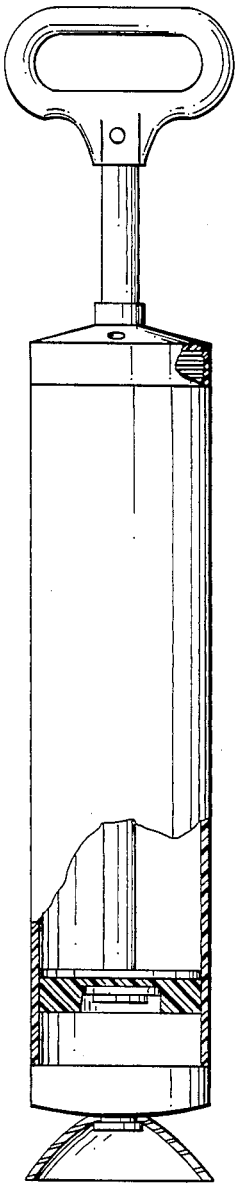
Fig. 1 PRIOR ART
FIG. 1 is a exploded view of the conventional structure.
Figure 2:
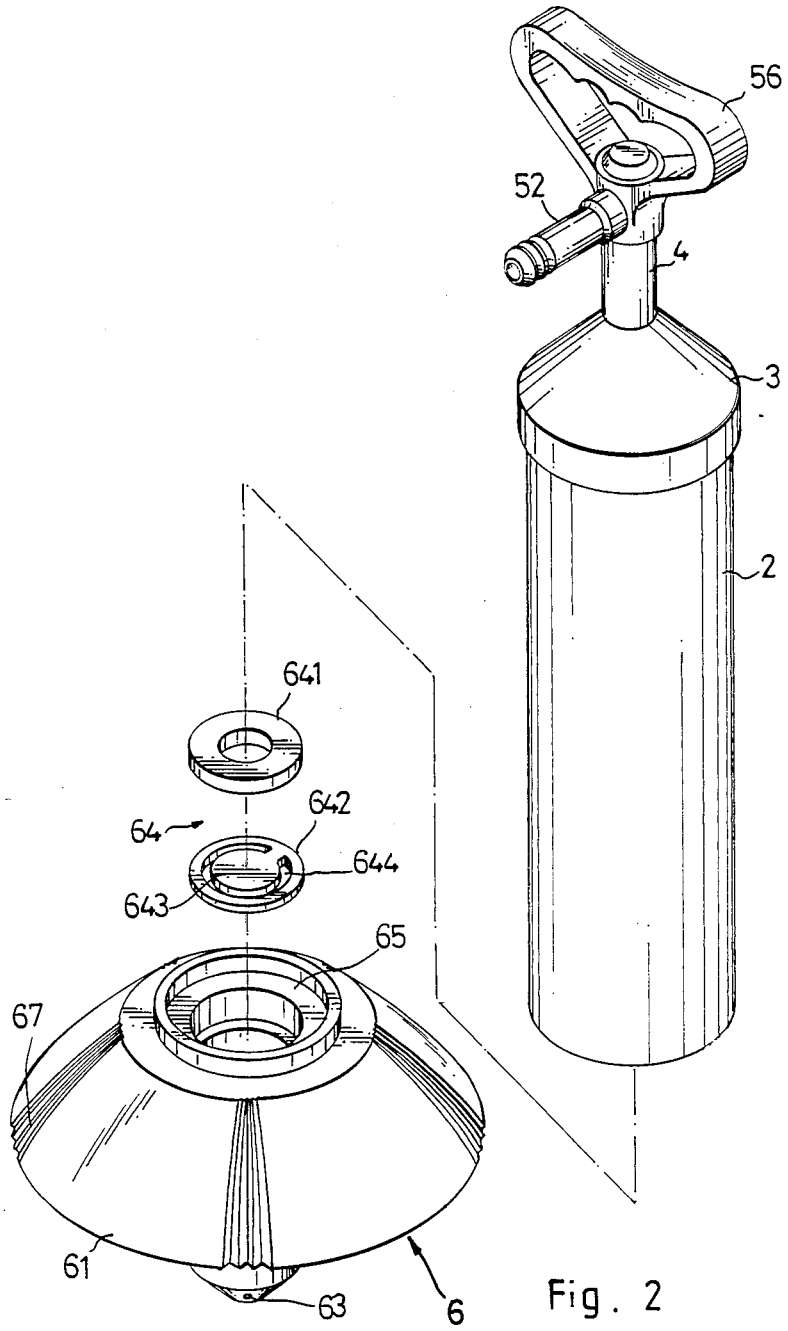
FIG. 2 is a exploded view of the present invention.
Figure 3:
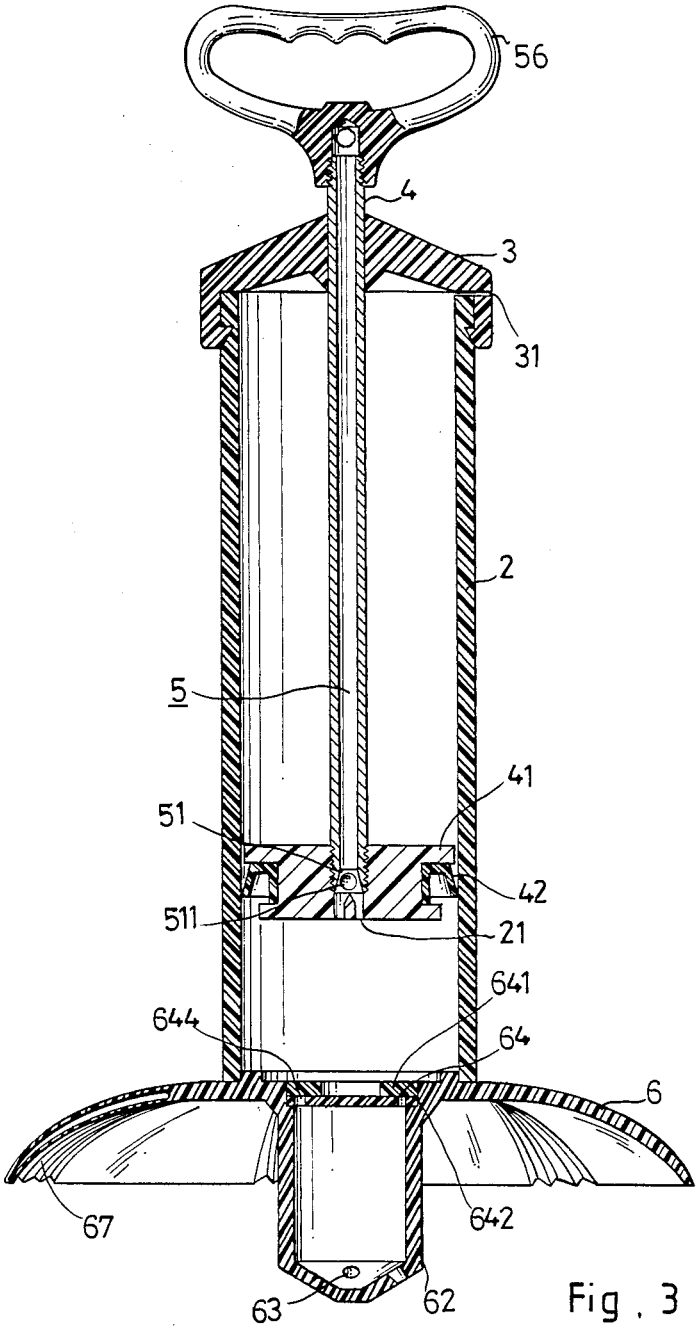
FIG. 3 is an assembled cross sectional view of the present invention.

Referring now to the drawings, the nature of this invention is described as follows:

As shown in FIGS. 2 and 3, the water and air whirlpooling double flush toilet clog remover comprises an air cylinder 2, a cover 3, a plug-type pressure lever 4, a fixed direction pouring or filling device 5, and a flow guide disc device 6. The upper end of the hollow air cylinder 2 aligns with the cover 3 for correct closure therebetween. The cover 3 is provided with an air port 31 which forms a gap with the end rim of the air cylinder 2 for providing a smooth control for the uplifting movements, when the cover 3 and air cylinder are assembled together. In the air cylinder 2, a hollow plug-type pressure lever 4 is provided which passes through the cover 3. The end of the plug-type pressure lever 4 that is positioned in the air cylinder 2 is sleeved with a piston body 41. A cup-form pad stop block or sealing ring 42 is sleeved on the piston body 41 which assists in conducting actions of expansion and contraction with the air cylinder 2 inner wall during the up and down operating and control displacement, thereby preventing any pressure from escaping out of the air port 31 during pushing and compression. Further, two small-caliber water inlets 21 are provided on bottom face of the piston body 41 and communicate with the hollow area within the plug-type pressure lever 4 and the fixed direction filling device 5. The filling device 5 includes a ball valve 51 having a bend ball 511. A duct 52 is located on one side of the handle 56 and communicates with the hollow pressure lever 4. This permits fluid to pass through the hollow pressure lever 4 when handle 56 is moved away from air cylinder 2. With this arrangement pipes of different diameters can be connected to plug-type pressure lever 4 by means of duct 52. The duct 52 can be directly connected to the common faucet, so as to be in fluid communication with ball 511 of the ball valve 51, and by this arrangement, operation of handle 56 can control the flow of water in and out of plug pressure lever 4 and fixed direction filling device 5. The bottom of the air cylinder 2 is closed by a flow guide disc device 6 which includes a suction disc 61 having a plurality of equally spaced and hollow corrugated retractable pleated bodies 67 designed to accommodate various drainage pipes during compression. With this arrangement the flow guide disc device can closely match the perimeter of drainage equipment of various specifications for proper positioning and for avoiding the sputter of dirty water during activation of the clog remover. An integrally formed concave slot 65 is provided on the center bottom of the suction disc 61 which has an unsealed top form which a duct 62 extends. At the end of duct 62, an oblique contracted plane is provided, and this oblique plane is provided with a plurality of air nozzles 63, which are formed of unequal angularly inner walls to meet the annular form of the oblique plane. Thus, the extended duct 62 can extend deep into the drainage pipe, thereby inhibiting impaction of the dirty water and overflow thereof by the push and compress action of handle 56. The unequal angular inner wall of the air nozzles 64 and the drainage pipe wall form a whirlpooling of water and/or air. Further, the concave slot 65, which is formed on the upper side of the extended duct 62 opposite to the upper side of the suction disc 61, is provided with a check valve 64 to seal off the upper empty state of the extended duct 62. The check valve 64 includes a hollow annular fixing plate 641 which positions the piston plate 642 on the concave slot 65. The piston plate 642 is an annular plate body having a large hollow area provided therein. A stop plate 643 is extended from the hollow area. One end of the stop plate 643 is connected to the piston plate 642. The stop plate is arranged to provide a gap 644 about the perimeter of the piston plate 642. The area of the stop plate 643 is slightly larger than that of the hollow part of the fixing plate 641. The gap 644 of the piston plate 642 can be covered and thus closed by the fixing plate 641. For example, during the downward push and compression of handle 56, the media (water-/air) pressure can push stop plate 643 away from fixing plate 641, so that the media can flow into the extend duct 62. During the upward pull back of handle 56, a force is formed which pushes the stop plate 643 against the fixing plate 641 to inhibit passage of fluid through the check valve 64, thereby avoiding back flow of the dirty water.

As shown in FIG. 3, in operation, the suction disc 61 is aligned at first with the perimeter of the drainage pipe for providing a fluidly tight arrangement therewith. The extended duct 62 extends deeply into the drainage pipe. Duct 52 can be connected to a water faucet so that water passing through the faucet causes the ball valve 51 to open in coordination with the upward pull of the plug-type pressure lever by handle 56. This causes water to pour into the cylinder 2. The suction force of the upward pull of the plug-type pressure lever 4 causes the check valve 64 to be in a closed state, which in turn inhibits dirty water form being sucked therein. The water which pours into cylinder 2 remains therein. When the plug-type pressure lever 4 is pushed down by pushing handle 56, a downward pressure and push compressive force is generated. This causes the ball valve 51 of the fixed direction pouring device 5 to close, thereby preventing flow of water there through. The compressed water medium forms a pressure which pushes the check valve 64 open and it then passes through the extended duct 62 and through the unequal angular inner walls of the air nozzles 63, thereby forming a second pressurization of flowing a water and/or air. At this time, the water squirts out of the nozzles at different angles to form, with the drainage pipe wall, a whirlpooling effect. Since the extended duct 62 can extend deep into the dirty water within the drainage pipe, the whirlpooling flow interacts directly with the dirty water in the drainage pipe which causes a larger whirlpooling water flow to impact the clogging matters and to push and wash out the clogging matters, thereby achieving the clearing effects. Further, in the above said operations, during the conduction and guidance of the water flow, the fixed direction device 5 can also, at the same time, cleanse and lubricate the air cylinder 2. The above said components can be formed of highly acidity-and-alkali-resistant rubber and plastic raw material and, therefore, are economical, beautiful, as well as durable.

I claim:

1. A water and air whirlpool double flush toilet drain opening clog remover, which comprises: a hollow cylinder having a top and bottom, and a top cover fixed on the top of the hollow cylinder;

the top cover having air ports to communicate the cylinder with the ambient;

a plug pressure lever having a top and bottom, being hollow, and communicating with an outside source of at least one of air and water for providing the at least one of air and water to the hollow cylinder; the plug pressure lever passing through the top cover and extending above and below the top cover, and the plug pressure lever having a handle being sleeved onto the top thereof, a piston means including a piston body affixed to the bottom of the pressure lever and having a pad arranged about its periphery for providing a fluid tight engagement between the piston body and the hollow cylinder, an upper portion of the piston body being affixed to the bottom of the plug pressure lever, and a lower portion of the piston body being provided with a water inlet arranged to permit fluid to fill the hollow cylinder from the plug pressure lever, a flow guide means fixed to the bottom of the hollow cylinder and having a suction disc for sealingly contacting an area around the drain opening as well as an extended duct communicating with the hollow cylinder for extending into the drain opening, the extended duct having a top and bottom with the bottom having a plurality of openings oriented obliquely with respect to the hollow cylinder and with respect to the drain opening so as to provide a whirlpool effect on the at least one of air and water as it enters the drain opening through the plurality of openings.

2. The water and air whirlpool double flush toilet clog remover according to claim 1, wherein the fixed direction filling means includes a ball valve for assuring one-way directional flow arranged within the piston body between the plug pressure lever and the two water inlets, the ball valve including a lever wall having different diameters and a ball, and a duct is provided in the handle communicating with the outside source of at least one of air and water for providing the at least one of air and water to the hollow cylinder through the plug pressure lever and the ball valve.

3. The water and air whirlpool double flush toilet clog remover according to claim 1, wherein the suction disc has a corrugated pleated body and the extended duct extends from a central portion of the flow guide means, the top of the extended duct having a form of concave slot communicating with the hollow cylinder, the bottom of the extended duct having a shape of a truncated cone with the openings being arranged on an oblique plane formed by the sides of the cone at the bottom of the extended duct.

4. The water and air whirlpool double flush toilet clog remover according to claim 1, wherein a check valve is provided within the concave slot, the check valve having hollow annular fixing plate, a piston plate, stop plate arranged within the piston plate having a portion thereof integral with the piston plate and providing a gap between the piston plate and the stop gate; the concave slot, piston plate and stop gate being arranged so that downward action of the piston body causes fluid to press the stop gate downward and away from the stop gate for permitting the fluid to pass through the check valve and that upward action of the piston body causes the stop gate to press against the fixing plate for preventing flow of water from the pipe to pass therethrough.

5. The water and air whirlpool double flush toilet clog remover according to claim 1, wherein the corrugated pleated body of the suction disc is hollow, elastic, compressible, and extensible, and is integrally formed on the suction disc to expand and contract under pressure, thereby closely fitting the clog remover to pipes of different sizes and preventing splashing of water from the pipes.

* * * * *